US007637285B2

(12) United States Patent
Weber

(10) Patent No.: US 7,637,285 B2
(45) Date of Patent: Dec. 29, 2009

(54) HYDRAULIC ACCUMULATOR

(75) Inventor: Norbert Weber, Sulzbach/Saar (DE)

(73) Assignee: Hydac Technology GmbH, Sulzbach/Saar (DE)

( * ) Notice: Subject to any disclaimer, the term of this patent is extended or adjusted under 35 U.S.C. 154(b) by 0 days.

(21) Appl. No.: 12/084,892

(22) PCT Filed: Sep. 26, 2006

(86) PCT No.: PCT/EP2006/009332

§ 371 (c)(1),
(2), (4) Date: May 13, 2008

(87) PCT Pub. No.: WO2007/085277

PCT Pub. Date: Aug. 2, 2007

(65) Prior Publication Data

US 2009/0107570 A1 Apr. 30, 2009

(30) Foreign Application Priority Data

Jan. 25, 2006 (DE) ..... 10 2006 004 120

(51) Int. Cl.
*F15B 1/04* (2006.01)

(52) U.S. Cl. ..... 138/30; 138/26

(58) Field of Classification Search ..... 138/30, 138/26

See application file for complete search history.

(56) References Cited

U.S. PATENT DOCUMENTS

| | | | | |
|---|---|---|---|---|
| 3,230,975 | A * | 1/1966 | Mercier | 138/30 |
| 3,232,318 | A * | 2/1966 | Mercier | 138/30 |
| 3,432,072 | A | 3/1969 | Quercia | |
| 3,874,544 | A * | 4/1975 | Harmon | 220/590 |
| 3,969,812 | A * | 7/1976 | Beck | 29/421.1 |
| 4,671,325 | A * | 6/1987 | Otter | 138/30 |
| 4,785,956 | A * | 11/1988 | Kepler et al. | 220/590 |
| 5,938,209 | A | 8/1999 | Sirosh et al. | |
| 6,484,900 | B1 | 11/2002 | Stiner et al. | |
| 7,363,944 | B2 * | 4/2008 | Lai | 138/30 |
| 7,493,916 | B2 * | 2/2009 | Rose | 138/30 |
| 2005/0194054 | A1 | 9/2005 | Moskalik et al. | |

FOREIGN PATENT DOCUMENTS

| | | |
|---|---|---|
| DE | 26 31 449 A1 | 1/1978 |
| DE | 40 35 785 C2 | 5/1992 |
| DE | 197 51 411 C1 | 1/1999 |
| EP | 0 550 951 A1 | 7/1993 |
| EP | 1 248 929 B1 | 3/2004 |
| FR | 2 193 953 A1 | 2/1974 |
| FR | 2 582 570 A1 | 12/1986 |
| GB | 2 419 381 A | 4/2006 |
| JP | 01 176898 A | 7/1989 |

* cited by examiner

*Primary Examiner*—James F Hook
(74) *Attorney, Agent, or Firm*—Roylance, Abrams, Berdo & Goodman, L.L.P.

(57) ABSTRACT

A hydraulic accumulator, in particular a bladder accumulator, includes two at least partially adjacent plastic casings (12, 14). The first plastic casing (12) has a collar part (16) at least at one end thereof. To produce a leakproof accumulator arrangement economical to produce, a gap opening (24) between the casings (12, 14) extends up to a point at which the casings (12, 14) are positioned together in a coaxial manner, and a disk valve (50) is provided as a valve for controlling the supply and discharge of the medium in the opening (10).

19 Claims, 3 Drawing Sheets

HYDRAULIC ACCUMULATOR

FIELD OF THE INVENTION

The present invention relates to a hydraulic accumulator, in particular a bladder accumulator for holding at least one fluid medium with a pressurized container. The container includes a first plastic casing and a second plastic casing at least partially encompassing the first plastic casing. The first plastic casing at least on one end has a collar part with an opening for the delivery and discharge of the medium. The collar part and the second plastic casing are supported on an interposed outside support ring tapering in the manner of a wedge in the direction of the gap opening between the two plastic casings.

BACKGROUND OF THE INVENTION

EP 1 248 929 B1 discloses a plastic core container reinforced with a fiber plastic composite as the inner plastic casing for storing liquid and/or gaseous media under pressure. The core container has one of more fittings in the neck part and/or the bottom part and/or the cylindrical container part. At least one fitting is made to hold a screw-on pressure line feed having a cylindrical or conical thread, such as, for example, a valve or a pipeline connection.

In the connection shank of the plastic core container, a cylindrical insert with a collar end extending peripherally or enveloping on the end of the connecting shank is mounted as the collar part. At least two seals are arranged such that at least one seal is located between the insert and the inside surface of the plastic connection shank of the plastic core container, and at least one other seal is located between the insert and pressure line feed. This arrangement ensures a high level of long-lasting tightness on the fitting even under extreme, cyclic thermal and mechanical operating stresses. Due to the sharp deflection site of the first inner plastic casing in the direction of the collar part by approximately 90°, it cannot be precluded that as a result of the sharp deflection site harmful stress peaks will occur. Although the outside support ring between the outer and inner plastic casings within the gap opening formed thereby tapers conically or in the manner of a wedge to the outside, the resulting support takes place only within the essentially horizontally running or extending contact region of the two plastic casings. As a result, relative movements damaging the plastic can occur between the casings in the contact region during operation of the device.

DE 197 51 411 C1 discloses a composite pressurized container for storage of gaseous media under pressure with a plastic liner as the inner or first plastic casing, with two neck pieces located in the neck region and with a winding of a fiber composite material reinforcing the liner as the second plastic casing. In the neck piece holding the gas check valve, a clamp ring can be screwed into this neck piece. The outer casing has a threaded section adjoined by an unthreaded, truncated cone-like section. The annular groove is located between the internal threaded sections of the neck piece for holding a gasket extends radially into the neck piece and on the outside of the neck piece. In the region adjoining the collar, the arrangement is provided with at least one bead extending radially to the outside over the entire periphery. Likewise, as in the above solution, the wedge-like taper of the outside support ring extends only along the inner peripheral region on the neck piece along a horizontal plane formed by the liner and deflected in turn at a sharp right angle, and ends in the collar part which encompasses the gas supply via the valve. This very effective sealing solution uses correspondingly great technical effort with several components for its implementation.

SUMMARY OF THE INVENTION

An object of the present invention is to provide an improved hydraulic accumulator that can be used in an economical manner at a reduced production cost and that is characterized by high reliability.

This object is basically achieved by a hydraulic accumulator where a gap opening between casings is routed as far as the site at which the casings are in contact with one another in a coaxial arrangement, and where triggering the delivery and discharge of media in the opening is by a valve. A tight accumulator arrangement is then created which can be implemented at low production costs. The hydraulic accumulator according to the present invention can be used for a plurality of applications. In that support takes place as far as into the outer peripheral region of the two casings by an outside support ring tapering in the manner of a wedge, relative movements which may occur between the plastic casings are accommodated by the outside support ring. Damaging delamination processes directly between the susceptible plastic materials are avoided. Furthermore, in this way stable and reliable support for the disk valve in the opening region of the pressurized container is created so that it is possible for the first time to use accumulators which are made entirely of plastic layers for bladder-hydraulic accumulator solutions and which are built with an extremely large volume. Furthermore, standard plastic materials, for example, in the form of polymer materials, can be used due to the wedge-like intermediate support for the plastic casings. This use helps cut production costs.

The contour surfaces of the first and second plastic casing facing one another can be implemented based on the wedge-like routing of the outside support ring leading into the outer peripheral region of the arrangement without sharp deflections and without sudden changes of direction. This structure enables especially careful application of force for the plastic casings. The application of force is especially favorable when the outside support ring is made in one piece and of a plastically deformable plastic material, especially of a polymer material.

Good results can, however, also be achieved when the outside support ring as a rigid support part body is composed of at least two individual segments, for example, in the manner of individual rings. This two-segment arrangement simplifies production, and accordingly helps reduce production costs. The outside support ring, to the extent it supports the collar part of the liner, can here be made of a metal material. The wedge-like tapering region between the plastic casings can be of a plastic material, for example, in the form of a plastically deformable buffer ring of polymer material. Depending on the production process, this plastically deformable plastic can also be injected or cast into the defined gap. If the buffer ring or the outside support ring as a whole is of a plastic material, this arrangement leads to a significant reduction of weight. This weight reduction increases the possible applications of the hydraulic accumulator, for example, in the field of aeronautics and space travel. Furthermore, as a result of the plastic configuration for the outside support ring or parts of it, it can be ensured that the plastic material on the casings will not be damaged on the sharp-edged transition sites. For a metal, individual ring-segment design, also for the buffer ring, high stiffness for the container arrangement can be established, so that depending on the application the hydraulic accumulator can be modularly produced according to requirements.

In one preferred embodiment of the hydraulic accumulator according to the present invention, in addition to the disk valve, on the opposite side on the accumulator a gas valve is used via which the interior of the membrane bladder can be filled. The membrane bladder can also be filled the first time or refilled on site by this gas valve.

In another preferred embodiment of the hydraulic accumulator according to the present invention, the outside contour of the outside support ring in the direction of the gap opening is provided with a convex curvature. Its opposite inside contour, proceeding from the gap opening, can extend in a straight slope which at the site of the entry of the collar part ends in a contact surface parallel to the longitudinal axis of the container. This configuration of the outside support ring with a convex curvature on the outside contour and a plane-parallel configuration on the inner contour side leads to especially favorable application of force of the loads of the inner casing into the outside support ring which in this respect is further supported by the outer plastic casing by winding.

Other objects, advantages and salient features of the present invention will become apparent from the following detailed description, which, taken in conjunction with the annexed drawings, discloses a preferred embodiment of the present invention.

BRIEF DESCRIPTION OF THE DRAWINGS

Referring to the drawings which form a part of this disclosure and which are schematic and not drawn to scale.

DETAILED DESCRIPTION OF THE INVENTION

Figure 1:
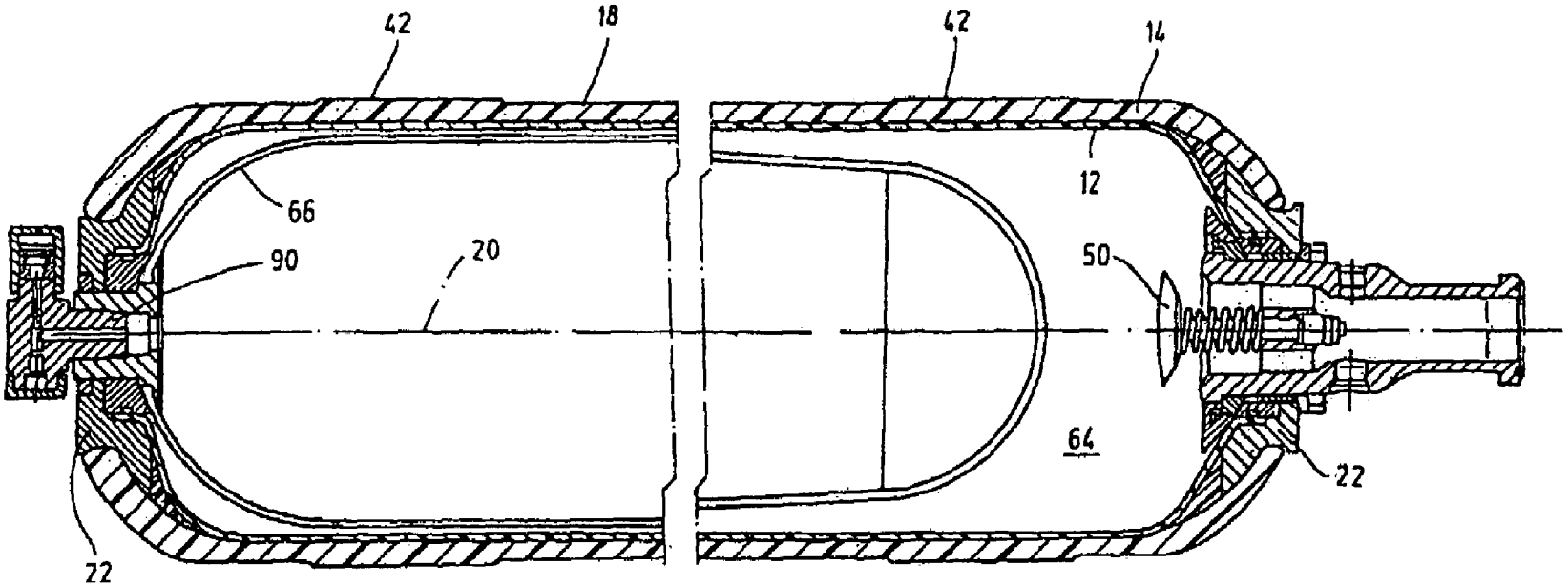
FIG. 1 is a side elevational view in section of a hydraulic accumulator made as a bladder accumulator, according to an exemplary embodiment of the present invention.

The hydraulic accumulator shown in the drawings in the form of a bladder accumulator is used to store liquid or gaseous fluid media which can be under a pressure of up to several thousand bar. It is provided on both ends with connection openings 10 for delivery and discharge of media, to which valves are connected, as described in detail below.

The actual pressurized container of the hydraulic accumulator has a first or inner plastic casing 12 and a second or outer plastic casing 14 at least partially surrounding the first plastic casing 12. This first plastic casing 12 is also referred to as a plastic core container or liner in the jargon of the trade. Casing 12 is of polyamide and is formed by a blow molding process or by rotary sintering. These production processes are conventional so that they will not be described in detail. The liner 12 is reinforced on the outer peripheral side by a fiber winding wound on from the outside as the second plastic casing 14. For example, the reinforcing winding is formed of a fiber reinforcement such as carbon fibers, aramid fibers, gas fibers, boron fibers, $Al_2O_3$ fibers or of mixtures thereof, also referred to as hybrid yarns, embedded in a basic matrix of duromers, such as epoxy or phenolic resins or in thermoplastics, for example, in the form of PA12, PA6, PP, etc.

The fiber composite material forming the support jacket contains fiber strands embedded in the plastic resin, crossing one another and extending essentially in the longitudinal and peripheral direction. The fiber composite material forming the support jacket can in addition or alternatively also comprise fiber strands crossing one another, tilted in the longitudinal and peripheral direction, and in one advantageous development of the longitudinal axis of the plastic core container assigned to one another tilted in mirror image. The forces directed longitudinal and peripherally can be optimally accommodated by the pressurized container. Moreover, the possibilities are improved for adjusting the ratio of the opening cross section of one face-side opening with reference to the inside diameter of the plastic core container to large values of at least 30%, preferably of at least 50%, without adversely affecting operation.

On each opposing end, the first plastic casing 12 ends in one cylindrical collar part 16. The illustrated hydraulic accumulator is made essentially rotationally symmetrical, and extends along its center periphery 18 with a coaxial arrangement of its two casings 12, 14 along its longitudinal axis 20. Viewed in the direction of this longitudinal axis 20, the free end of the second plastic casing 14 ends above or beyond the respective collar part 16 of the first plastic casing 12. This arrangement has proven favorable for the forces to be delivered during operation of the container. The collar part 16 of the first plastic casing 12 and the second plastic casing 14 are otherwise supported on the outside support ring 22 lying inside between them. The outside support ring 22 tapers in the direction of the gap opening 24 between the casings 12, 14 in the manner of a wedge. According to the present invention, the gap opening 24 between the casings 12, 14 is routed as far as the location at which the casings 12, 14 in a coaxial arrangement to the longitudinal axis 20 of the accumulator are in contact with one another, the wedge-like taper 26 of the outside support ring 22 leading as far as this site. The outside support ring is either made in one piece (not shown), or, as shown in the figure, of at least two annular individual segments 28, 30. The individual segment 28 is of a conventional metal material. The individual ring 30 is of a plastic material, preferably made in the manner of a buffer ring of a plastically deformable polymer material. Instead of the two individual segments 28, 30, other individual segments, in the manner of a sandwich construction can be provided, or the outside support ring 22 instead of a one-piece metal execution could be of plastic.

The outside contour 32 of the outside support ring 22 in the direction of the gap opening 24 is provided with a convex curvature. Its opposite inside contour 34 extends, proceeding from the gap opening 24, in a straight slope ending at the site of the entry of the collar part 16 into a contact surface parallel to the longitudinal axis 20 of the hydraulic accumulator. The curvature of the outside contour 32 increases in the direction of the free end of the second plastic casing 14. These inside and outside contour configurations for the outside support ring 22 ensure good application of force and reliable coupling of the plastic casings 12, 14 in the region of each outside support ring 22. Furthermore, the liner in the form of the plastic casing 12 extends parallel to the oblique contour extending in a straight line on the inside of the outside support ring 22, with the result that the deflection of the liner in the direction of the collar part 16 takes place parallel to the longitudinal axis 20 of the hydraulic accumulator with an angle greater than 90°, so that in this respect sharp deflections for the susceptible liner are avoided.

If the outside support ring 22, as shown, is of individual segments, at least one of the two individual segments 28 or 30 in the edge-side region can have a projection ending in the manner of an overlap in an edge-side radial depression of the other individual segment. In this way especially good adhesion of the two individual segments to one another is possible. Viewed in cross section as shown in the figures, one individual segment 30 is made in the manner of a feed edge and the other individual segment 28 as far as the free end of the respective collar part 16 is made in the manner of a parallelogram.

The respective collar part 16 of the first casing 12 is supported on the inner peripheral side on another contact surface of the respective inside support ring 36, preferably made as a rigid metal ring. As the figures show, the inside support ring 36 need not be made the same for the two ends of the hydraulic accumulator. The respective inside support ring 36 along its outer peripheral surface has an annular groove for holding the O-ring 38 used to seal the respective media delivery and discharge. Furthermore, the inside support ring 36 is supported in the outside support ring 22 such that a common boundary wall for delivery and discharge of the medium is formed. The illustrated inside support ring 36 in the direction of the interior of the pressurized container is provided with a contact bevel having a tilt matched to the tilt of the bevel of the inside contour 34 of the outside support ring 22 and in particular corresponding to it. This bevel is used in particular as a later contact surface for the illustrated valve arrangements of the hydraulic accumulator, still to be detailed. Furthermore, the outside contour 32 of the outside support ring 22 is provided with a ring-shaped recess 40 in which the assignable end of the second plastic casing 14 ends with contact on the end side.

On both sides of the center periphery 18 the second plastic casing 14 has a least one additional winding layer 42. Additional winding layer 42 helps to increase the bursting pressure, and ensures that in case of bursting any solid internal parts of the pressurized container or accumulator cannot be shot to the outside. Rather, such parts are retained by the additional winding 42. Depending on the overall length of the accumulator, this additional winding 42 may be present only once or repeatedly at discrete distances from one another. The outside support ring 22 is able to uniformly distribute the stress peaks occurring in the manner of a pressure buffer and to deliver them into the two plastic casings 12, 14. In this way, bulging of the pressurized container is effectively avoided. Since in the sense of sliding motion in the coaxial region extremely small delaminating relative movements can occur between the facing sides of the plastic casings 12, 14, it is sufficient here to support and separate the layers of the two casings 12, 14 from one another in the end-side enclosure region by the outside support ring 22. The illustrated cross sectional wedge shape of the outside support ring 22 is favorable to the extent it effectively counteracts the relative displacements, to which the different configuration of the outside contour 21 to the inside contour 34 contributes in a supportive manner. In spite of the circumstance that only smooth surfaces are used for the pressurized container solution, in particular relative to the inside support ring 36 and the outside support ring 22, it is surprising that in this way a high-strength and stiff connecting part in the region of the collar part 16 is achieved in a structurally simple manner.

Figure 2:
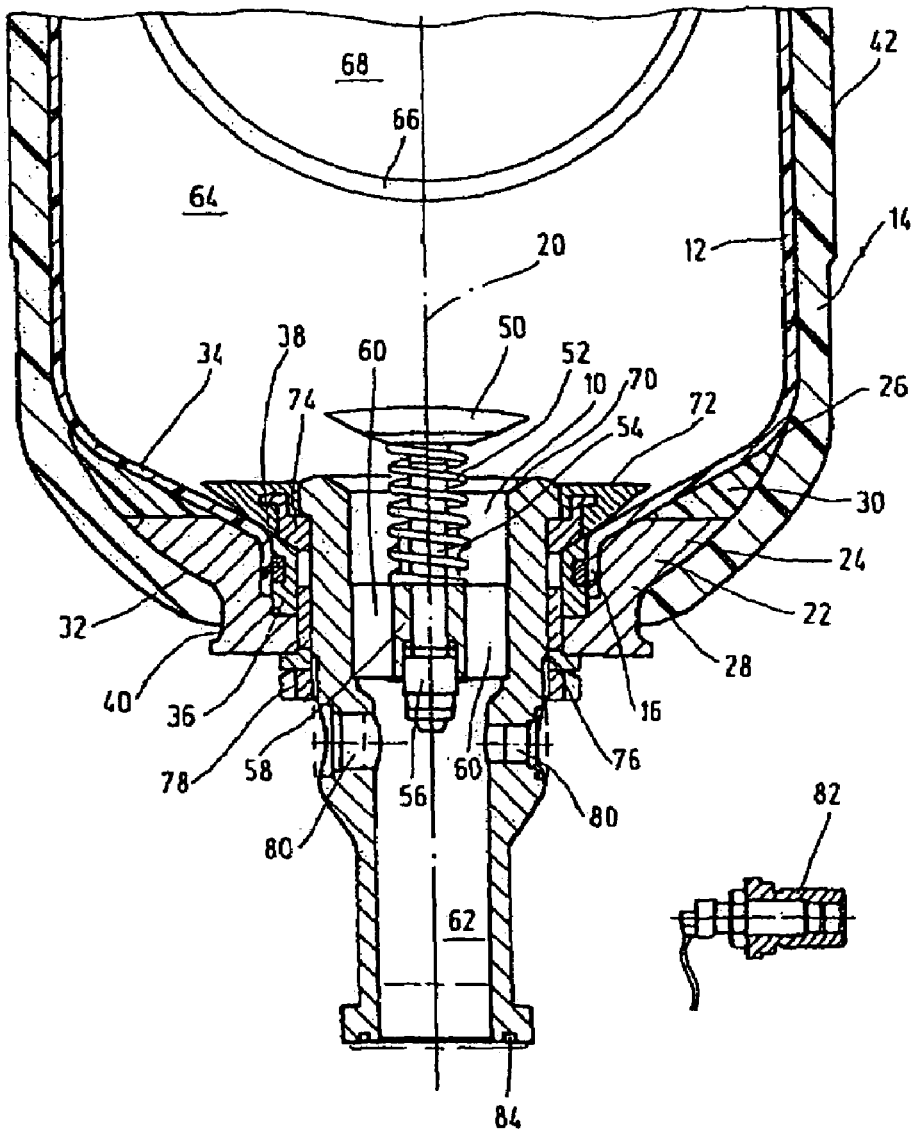
FIG. 2 is a partial, enlarged, side elevational view in section of a hydraulic fluid end region of the hydraulic accumulator shown in FIG. 1.

In the direction of FIG. 2, on the bottom of the tank arrangement the fluid valve is a so-called disk valve 50. The disk of the disk valve 50, as shown in FIG. 2, is held in its open position by a compression spring 52 and otherwise the disk is borne by an actuating rod 54 extending through the compression spring 52 and designed to limit the maximum opening stroke on its bottom with a stop 56. As shown in FIG. 2, stop 56 strikes the bridge walls 58 of a guide which in the axial direction parallel to the longitudinal axis 20 of the hydraulic accumulator exposes diametrically opposite fluid passages 60. The fluid passages 60 discharge in the direction of FIG. 2 on their lower end into a fluid-carrying fitting 62 in the manner of a standardized SEA flange. On their opposite end, passages 60 discharge into the fluid space 64 of the hydraulic accumulator. This fluid space 64 is separated from another gas-carrying working space 68 by an elastomer separating membrane in the form of a bladder 66. If fluid, for example, in the form of a hydraulic medium such as oil, is retrieved from the fluid space 64 via the fitting 62 into a hydraulic circuit, the elastically yielding bladder 66 expands under the pressure of the working gas, for example, in the form of nitrogen. Viewed in the direction of FIG. 2, the bladder presses the disk of the disk valve 50 down until at most in the complete closed position the disk comes into contact with the conical closing surfaces 70 of the SAE flange projecting in this respect into the fluid space 64.

If the SAE fitting projects into the fluid space 64, in an adjacent arrangement, the conical closing surfaces 70 are encompassed by an elastically yielding stop surface 72 and are held on the flange by a bent collar piece 74. With its bottom, this collar piece 74 is supported on the inside contour of the obliquely extending liner 12. Furthermore, the collar piece 74 on its inner peripheral side is held on the SAE flange, which flange widens in diameter over a projection on the outer peripheral side. Otherwise, this SAE flange is made cylindrical in the passage region, and viewed in the direction of FIG. 2 is supported on the bottom of the outside support ring 22 by a support sleeve 76. The support sleeve 76, on the outer peripheral side, is in flat contact with the inner peripheral sides of the outside support ring 22 and the inside support ring 36. In order to reliably attach this arrangement in the region of the media delivery and discharge 10 in the accumulator housing, a screw ring 78 braces the arrangement which can be clamped onto the SAE flange in this respect over the outside threaded segment. Underneath the screw ring 78 fixed in this way, the SAE flange is penetrated by two diametrically opposing holes 80 used, for example, to hold sensors to measure pressure, temperature, viscosity and the like. The pressure sensor 82, shown at the right viewed in FIG. 2 as a screw-in part, is held integrated into the hole 80 shown at left. To achieve better installation capacity of these parts, in particular the collar piece 74 can be built as a multi-piece, in particular two-part ring. Furthermore, the SAE flange viewed in the direction of FIG. 2 on its end-side bottom has an annular recess 84 used to hold an O-ring (not shown), so that in this respect the SAE flange can be connected to the fluid circuit of a hydraulic system (not shown), forming a seal.

Figure 3:
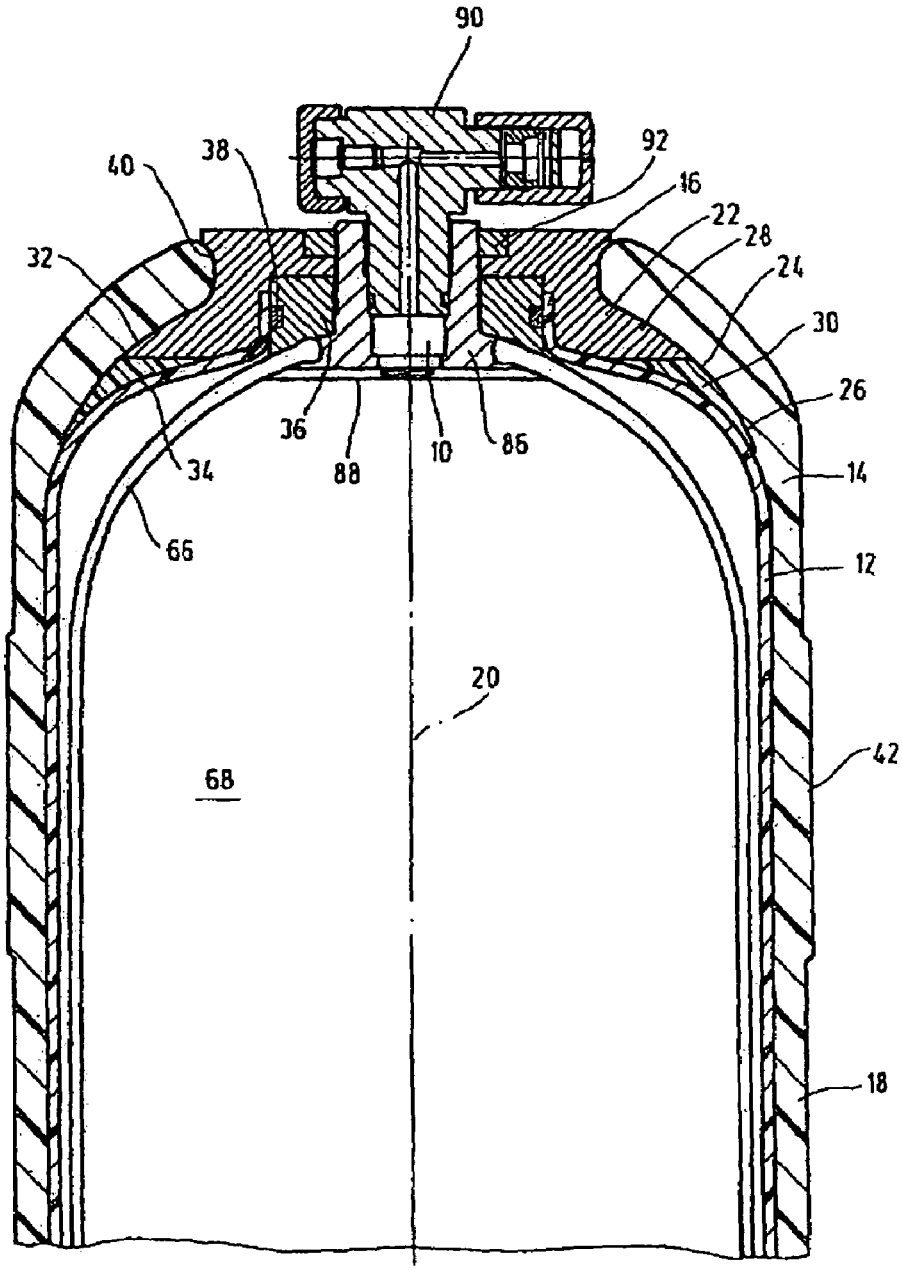
FIG. 3 is a partial, enlarged side elevational view in section of a gas end region of the hydraulic accumulator shown in FIG. 1.

As FIG. 3 shows, the membrane wall of the bladder 66 on its top is held in a membrane holding device 86 with its bottom connected into the transverse wall 88 of the bladder arrangement. In this transverse wall region, a passage site 10 is exposed for gas supply via the media supply valve 90. This valve 90 is of conventional design, and is not described in detail. Valve 90 can be screwed into the internal thread of the membrane holding device 86 by its corresponding outside thread. For reliable holding of the bladder 66, it is somewhat thickened in diameter on its free end. The membrane holding device 86 clamps the free end of the bladder 66 against the inclined contact surface of the inside support ring 36 resting with its inside periphery against the outside periphery of the membrane holding device 86. The membrane holding device 86 with a slight projection penetrates the fitting 22, and is fixed in position in it via a pressure ring 92. In the illustrated pressurized container, the plastic core container has an inside diameter of 240 mm and the connecting ring has an inside diameter of 140 mm. The pole ratio is computed therefrom, i.e., the ratio of the inside diameter of the plastic core container 12 and the inside diameter of the connecting ring or inside support ring 36 of 58%, i.e., a value greater than 50%. This value facilitates accommodation of internals in the plastic core container, such as the valves 50 and 90.

While one embodiment has been chosen to illustrate the invention, it will be understood by those skilled in the art that various changes and modifications can be made therein without departing from the scope of the invention as defined in the appended claims.

What is claimed is:

1. A hydraulic accumulator, comprising:

a first plastic casing including a first end having a collar part with an opening;

a valve coupled to said first plastic casing and controlling delivery and discharge of medium to and from inside said first plastic casing by moving between open and closed positions;

a second plastic casing at least partially encompassing said first plastic casing, said casings extending along a longitudinal axis;

a gap opening between said first and second plastic casings extending as far as a site where said casings are in contact and coaxial with one another;

an outside support ring interposed between and supporting said collar part in said gap opening, said outside support ring tapering as a wedge and having an outside contour with a convex curvature in a direction of said gap opening and an opposite inside contour, said inside contour proceeding from said gap opening and extending in a straight slope ending at a site of entry of said collar part into a first contact surface parallel to said longitudinal axis;

an inside support ring within said outside support ring and having a beveled stop and a second contact surface supporting said collar part on an inner peripheral side thereof; and an accumulator bladder within said first plastic casing having an open end held in a membrane holding device forming a passage for delivery of medium through a media supply valve, said membrane holding device pressing said open end of said bladder against said beveled stop of said inside support ring forming a common boundary wall with said membrane holding device.

2. A hydraulic accumulator according to claim 1 wherein said outside support ring is made of one piece.

3. A hydraulic accumulator according to claim 1 wherein said outside support ring comprises at least two individual annular segments.

4. A hydraulic accumulator according to claim 3 wherein at least one of said individual annular segments is plastic.

5. A hydraulic accumulator according to claim 1 wherein said beveled stop has a tilt corresponding to a tilt of a bevel of said inside contour of said outside support ring.

6. A hydraulic accumulator according to claim 1 wherein said outside contour of said outside support ring comprises a ring-shaped recess receiving an end of said second plastic casing.

7. A hydraulic accumulator according to claim 1 wherein said first plastic casing is a plastic liner produced by one of blow molding, rotary molding and another thermal process.

8. A hydraulic accumulator according to claim 1 wherein said second plastic casing comprises a winding of at least one type of fiber forming a reinforcement for said first plastic casing.

9. A hydraulic accumulator according to claim 8 wherein said second plastic casing comprises additional windings on an outer periphery thereof spaced at discrete distances.

10. A hydraulic accumulator according to claim 1 wherein said inside support ring is a rigid metal ring.

11. A hydraulic accumulator, comprising:

a first plastic casing including opposite first and second ends having first and second collar parts with first and second openings, respectively;

a second plastic casing at least partially encompassing said first plastic casing, said casings extending along a longitudinal axis;

first and second gap openings between said first and second casings adjacent said first and second ends, respectively, each of said gap openings extending as far a site where said casings are in direct contact and coaxial with one another;

first and second outside support rings interposed between said first and second casing in said first and second gap openings, respectively, each of said outside support ring tapering outwardly as a wedge and having an outside contour with a convex curvature in a direction of the respective gap opening and an opposite inside contour proceeding from the respective gap opening and extending in a straight slope ending at a site of entry of the respective collar part into a first contact surface parallel to said longitudinal axis;

first and second inside support rings with said first and second outside support rings, respectively, each of said inside support rings having a beveled stop and a second contact surface supporting the respective collar part on an inner peripheral side thereof;

a disk valve in said first collar part controlling delivery of medium to and from inside said first plastic casing by moving between open and closed positions; and an accumulator bladder with said first plastic casing having an open end held in a membrane holding device located in said second collar part and forming a passage for delivery of medium through a medium supply valve connected to said second inner and outer support rings, said membrane holding device pressing said open end of said bladder against said beveled stop of said second inside support ring forming a common boundary wall with said membrane holding device.

12. A hydraulic accumulator according to claim 11 wherein each said outside support ring is made of one piece.

13. A hydraulic accumulator according to claim 11 wherein each said outside support ring comprises at least two individual annular segments.

14. A hydraulic accumulator according to claim 13 wherein at least one of said individual annular segments is plastic.

15. A hydraulic accumulator according to claim 11 wherein each said beveled stop has a tilt corresponding to a tilt of a bevel of said inside contour of the respective outside support ring.

16. A hydraulic accumulator according to claim 11 wherein said outside contour of each said outside support ring comprises a ring-shaped recess receiving an end of said second plastic casing.

17. A hydraulic accumulator according to claim 11 wherein said first plastic casing is a plastic liner produced by one of blow molding, rotary molding and another thermal process.

18. A hydraulic accumulator according to claim 11 wherein said second plastic casing comprises a winding of at least one type of fiber forming a reinforcement for said first plastic casing.

19. A hydraulic accumulator according to claim 18 wherein said second plastic casing comprises additional windings on an outer periphery thereof spaced at discrete distances.

* * * * *